US008430709B1

(12) United States Patent
Wong

(10) Patent No.: US 8,430,709 B1
(45) Date of Patent: Apr. 30, 2013

(54) DETACHABLE PROPELLER FOR FLYING TOYS

(75) Inventor: Kwok Leung Wong, Causeway Bay (HK)

(73) Assignee: Silverlit Limited, Causeway Bay (HK)

( * ) Notice: Subject to any disclaimer, the term of this patent is extended or adjusted under 35 U.S.C. 154(b) by 0 days.

(21) Appl. No.: 13/562,181

(22) Filed: Jul. 30, 2012

(51) Int. Cl.
*A63H 27/00* (2006.01)

(52) U.S. Cl.
USPC ..... 446/34; 446/57

(58) Field of Classification Search ..... 446/34–36, 446/57–60, 93, 120
See application file for complete search history.

(56) References Cited

U.S. PATENT DOCUMENTS

| | | | | |
|---|---|---|---|---|
| 1,995,447 | A * | 3/1935 | Daniel | 446/59 |
| 2,543,516 | A * | 2/1951 | Walker | 446/59 |
| 2,756,537 | A * | 7/1956 | Ernst | 446/33 |
| 3,718,009 | A * | 2/1973 | Perina | 464/30 |
| 3,757,461 | A * | 9/1973 | Chang et al. | 446/58 |
| 3,777,420 | A * | 12/1973 | Bosley et al. | 446/58 |
| 3,940,882 | A * | 3/1976 | Mabuchi | 446/58 |
| 4,318,455 | A * | 3/1982 | Lapierre | 185/39 |
| 5,525,087 | A * | 6/1996 | Chin-Lin | 446/59 |
| 6,758,436 | B2 * | 7/2004 | Rehkemper et al. | 244/17.11 |
| 2012/0177497 | A1 * | 7/2012 | Huang et al. | 416/204 R |

FOREIGN PATENT DOCUMENTS

| | | |
|---|---|---|
| CN | 101653661 B | 5/2011 |

* cited by examiner

*Primary Examiner* — Gene Kim
*Assistant Examiner* — Alyssa Hylinski
(74) *Attorney, Agent, or Firm* — Greenberg Traurig, LLP

(57) ABSTRACT

A flying toy has a propeller rotated by the first motor mounted on the body. A propeller holder mounts the propeller. An end cap is located to the front of the propeller holder, and there is a snap joint between the holder and the end cap. The end cap is removable by disengagement of holder and end cap at the snap joint, and the propeller is releasable from the holder by a human hand and without a tool. When the toy crashes, the propeller is forced relatively free from the drive force rotating the holder and back towards the body and is trapped against separation from the toy.

18 Claims, 14 Drawing Sheets

DETACHABLE PROPELLER FOR FLYING TOYS

FIELD OF THE DISCLOSURE

This disclosure concerns flying toys.

BACKGROUND

Flying toys have been known for many years. These can be planes and helicopters. Such toys use a propeller or rotor system for propulsion and/or lift.

For a flying toy such as a helicopter or plane, the propeller is usually located on nose of canopy for plane or top for helicopter. When the flying toy hits to a hard surface or rigid object along the direction of fight, an impact force is exerted to the propeller directly. Since the propeller is made of plastic material, if there is no cushion to absorb the energy, this impact force is sometimes large enough to break the propeller. Additionally, in most propulsion design, the propeller is either linked firmly on the motor shaft or through the output shaft of gearbox. Without appropriate tools with skill, it is difficult for children to replace the propeller. As a result, the toy is damaged easily.

The present disclosure relates to a propeller and blade mechanism designed to minimize or overcome these problems.

Accordingly, it would be desirable to have an improved structure for a flying toy airplane that is more resistant to damage from a crash and/or from regular usage such as landing.

SUMMARY

The present disclosure relates generally to flying toy airplane structures, and, more particularly, to a propulsion system for a flying toy airplane.

Flying toy airplanes, often also referred to as toy flying airplanes, have enjoyed a long-lasting and extensive popularity among children and adults for many years. The continuous development of toy airplanes has included the development of small scale self-powered toy or toy airplanes intended for amusement and entertainment. In addition, remotely controlled aircraft using either a controlling tether or radio signal transmission link has further improved the realism and enjoyment of toy and toy airplanes.

Toy airplanes capable of flight typically use one or more small electric motors driving one or more propellers. These motors and propellers are mounted on the front of the wings of the airplane. Because toy airplanes often crash into the earth or another obstacle, this placement of the propellers often leads to damage of the propellers and/or motors when the plane crashes.

Also there are available radio control (RC) toy planes typically with one propeller on the plane nose. Propellers and/or motor shafts can be very easily distorted or even broken while landing or during a crash. This will reduce the later flying performance and even product life. Also, for indoor play, the use of a high speed propeller on the front of the plane is hazardous.

In present disclosure, there is a propeller and rotor mechanism for use with a toy and which is structured and configures to be mounted with the drive shaft and the body in manner minimizing damage to the propeller or rotor and the toy in the event of a crash of the toy. The present disclosure is a detachable mechanism which is designed so as to minimize or overcome the problems of the prior systems.

The disclosure is further described with reference to the accompanying drawings.

BRIEF DESCRIPTION OF THE DRAWINGS

The novel features of this disclosure, as well as the disclosure itself, both as to its structure and its operation, will be best understood from the accompanying drawings, taken in conjunction with the accompanying description, in which similar reference characters refer to similar parts, and in which.

DETAILED DESCRIPTION

Figure 1:
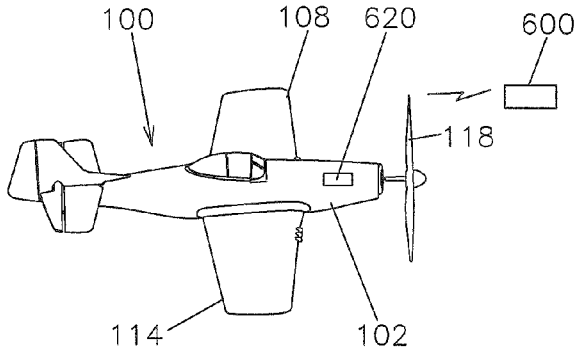
FIG. 1 is perspective view of a normal plane and also showing receiver and transmitter.
Figure 2A:
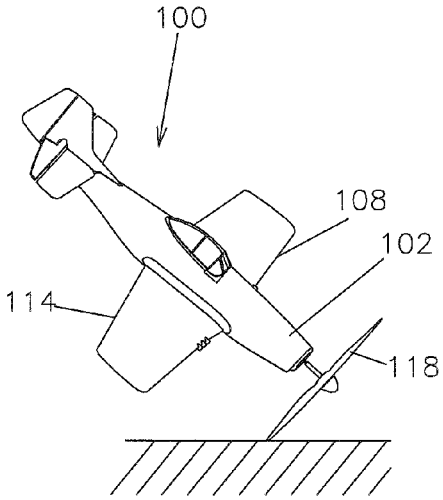
FIG. 2*a* is a perspective view of the plane as it initially impacts a hard surface.
Figure 2B:
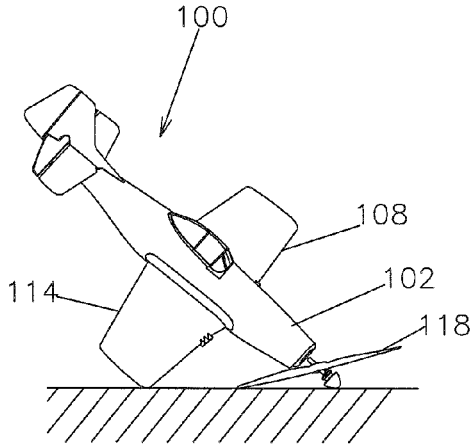
FIG. 2*b* is a perspective view of the plane as it further impacts on the hard surface and the propeller is moved out from the propeller holder.
Figure 3A:
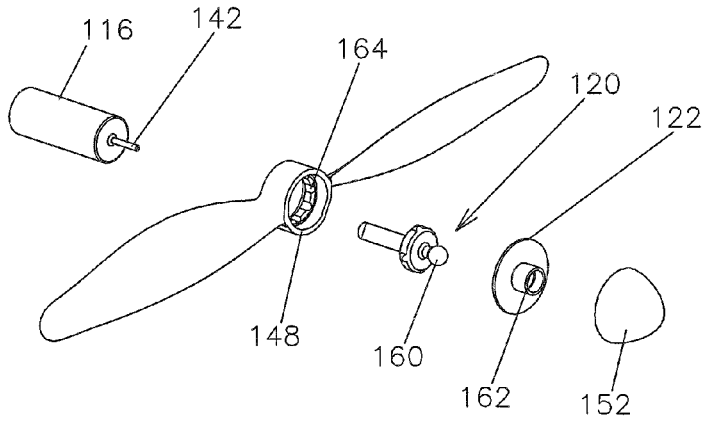
FIG. 3*a* is a perspective exploded view of the present disclosure showing the propeller directly driven by motor.
Figure 3B:
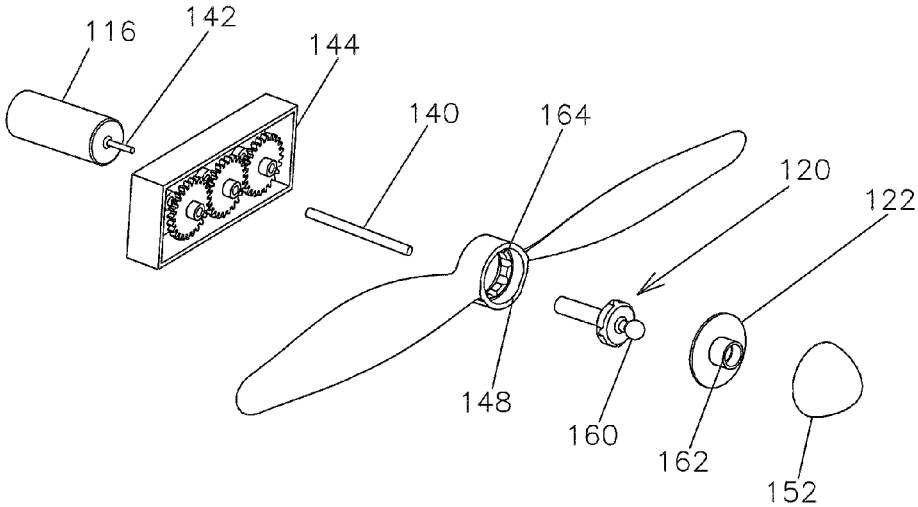
FIG. 3*b* is a perspective exploded view of the present disclosure showing the propeller driven by a gear box.
Figure 4:
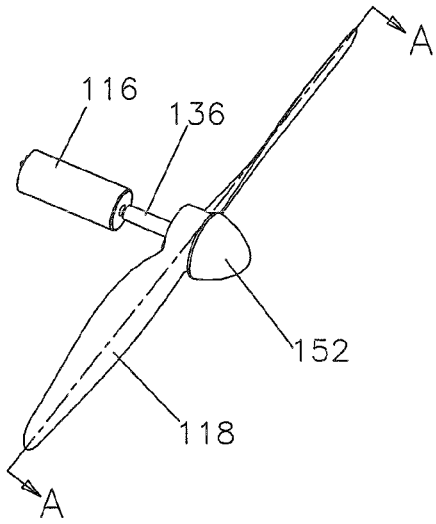
FIG. 4 is a perspective view of the present disclosure showing the detachable propeller mechanism before a hit on a hard surface.
Figure 5:
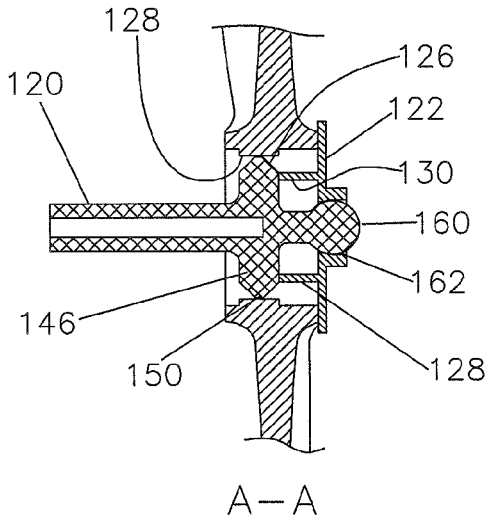
FIG. 5 is a cross-sectional view of FIG. 4.
Figure 6:
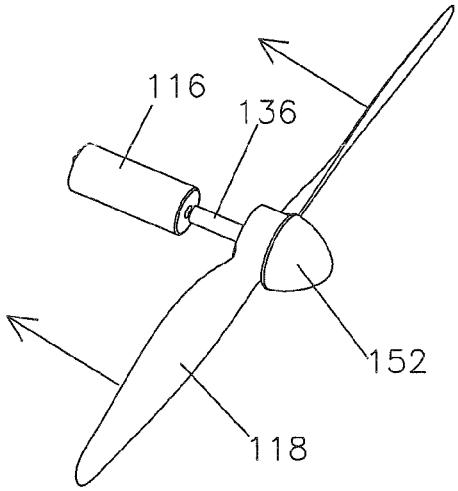
FIG. 6 is a perspective view of the present disclosure showing the moving direction of propeller upon a hit.
Figure 7:
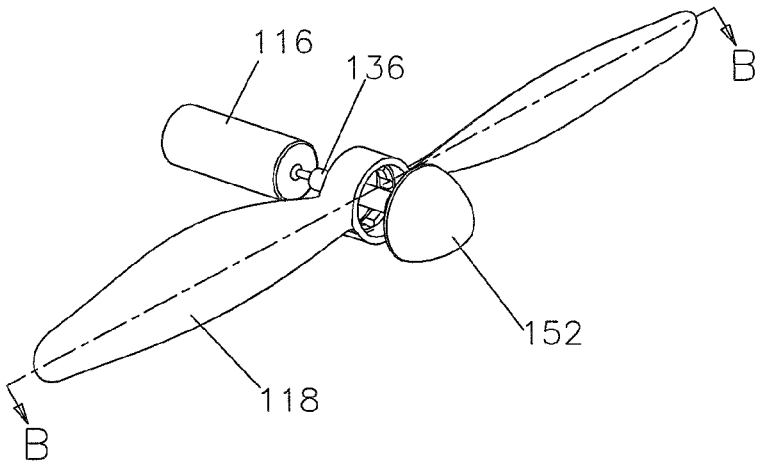
FIG. 7 is a perspective view of the present disclosure of detachable propeller mechanism after hit.
Figure 8:
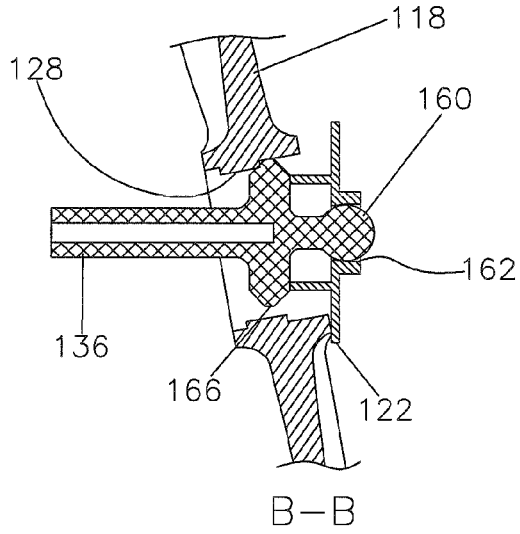
FIG. 8 is a cross-sectional view of FIG. 7.
Figure 9A:
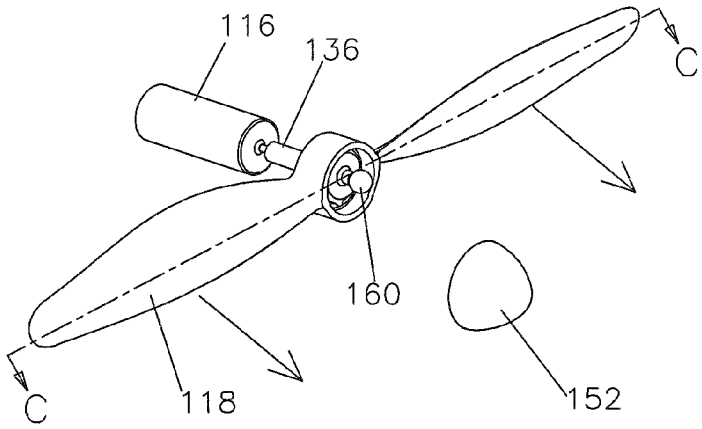
FIG. 9*a* is a perspective view of the present disclosure of the detachable propeller mechanism for propeller replacement.
Figure 9B:
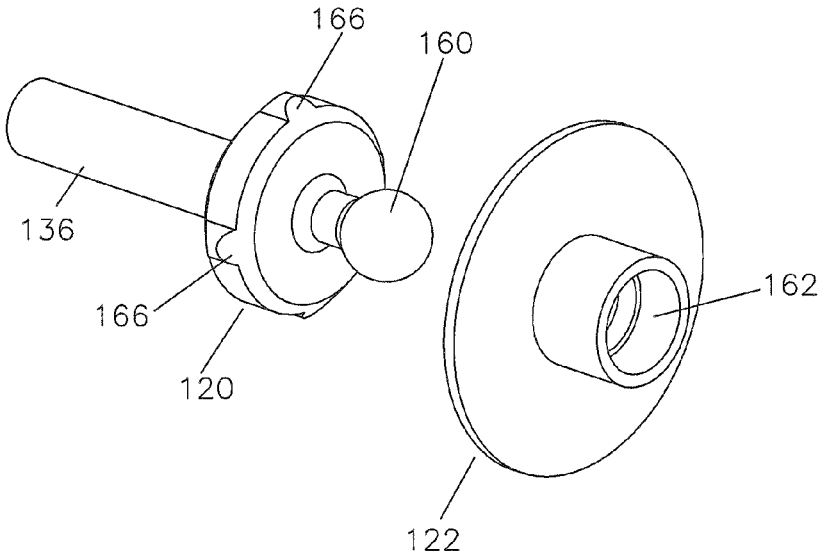
FIG. 9*b* is a perspective view of the present disclosure of the end cap and propeller holder design.
Figure 10A:
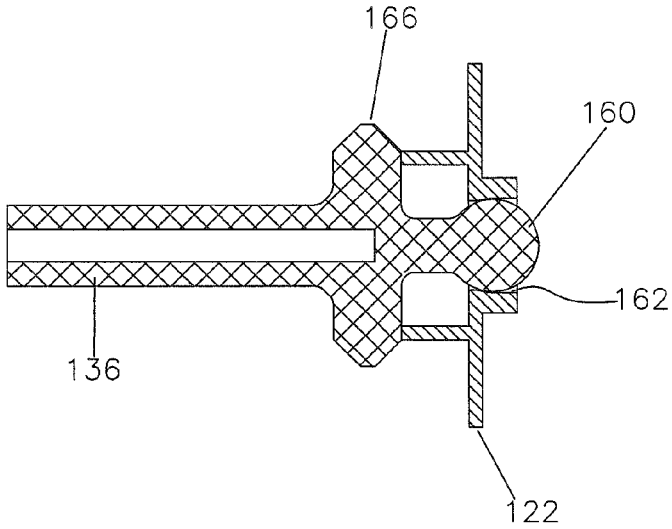
FIG. 10*a* is a cross-sectional view of end cap snapped with propeller holder properly.
Figure 10B:
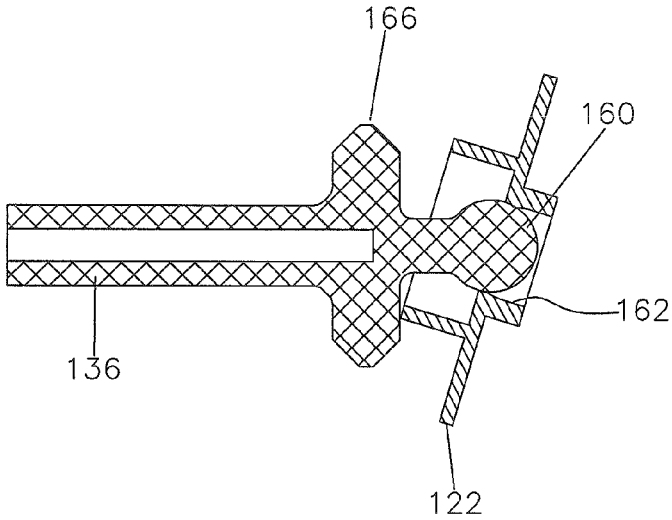
FIG. 10*b* is a cross-sectional view of end cap disengaging from propeller holder.
Figure 11:
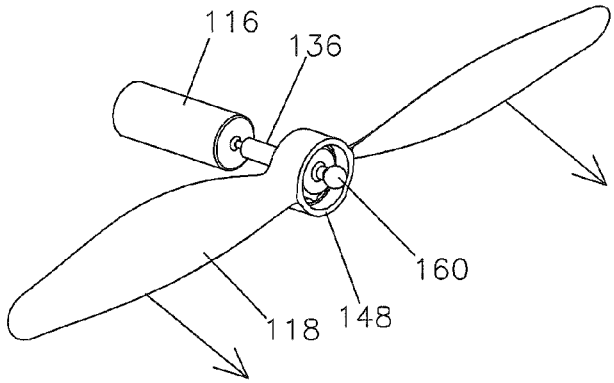
FIG. 11 is a perspective view of the present disclosure of the moving direction of propeller for replacement.
Figure 12A:
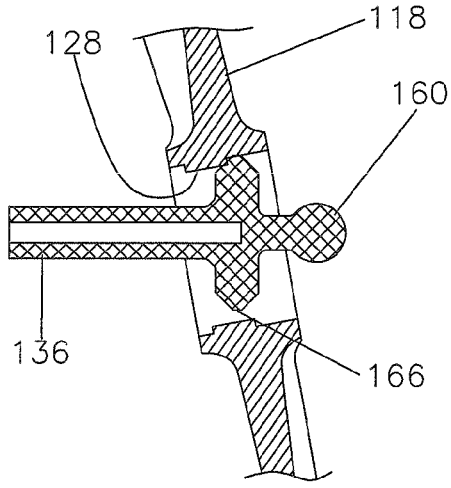
FIGS. 12*a* and 12*b* are cross-sectional views showing the propeller detaching from propeller holder while replacement.
Figure 12B:
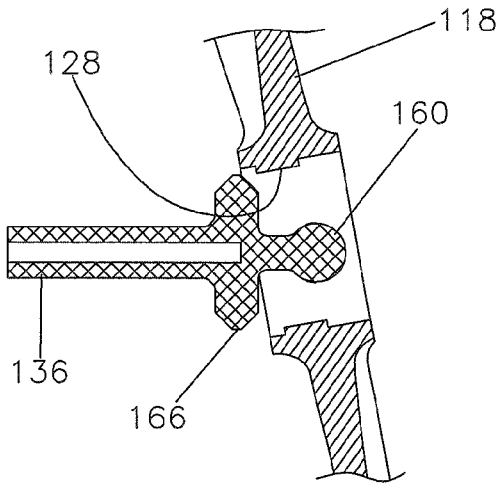
Figure 13A:
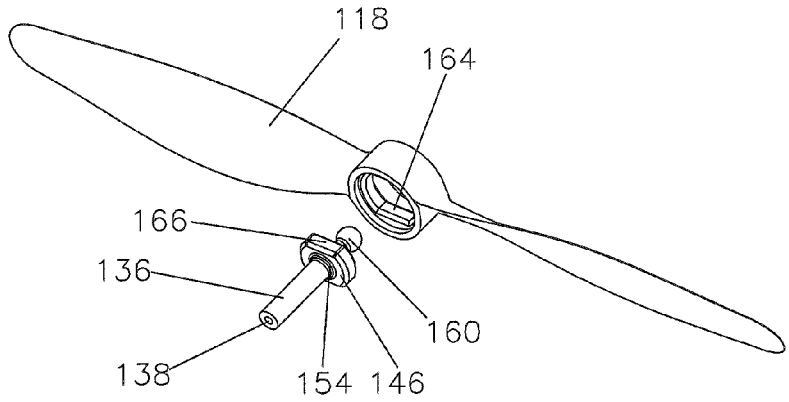
FIGS. 13*a* to 13*c* are different forms of slot design between propeller and propeller holder.
Figure 13B:
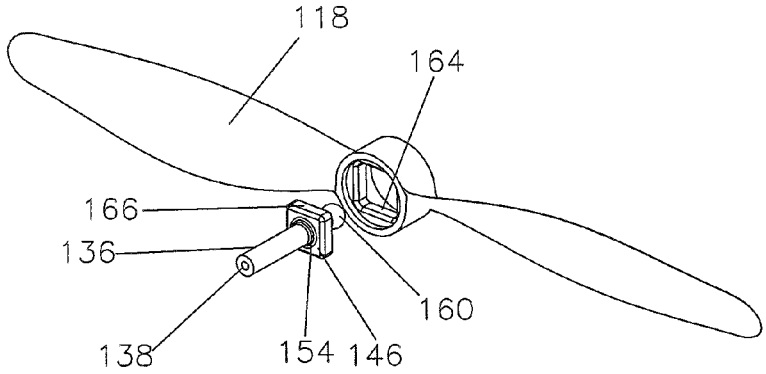
Figure 13C:
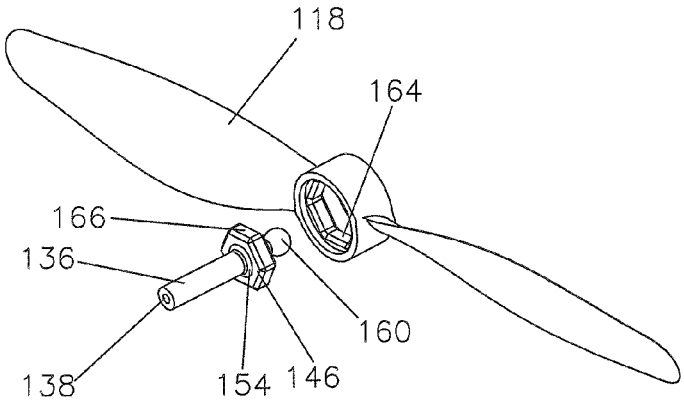
Figure 14A:
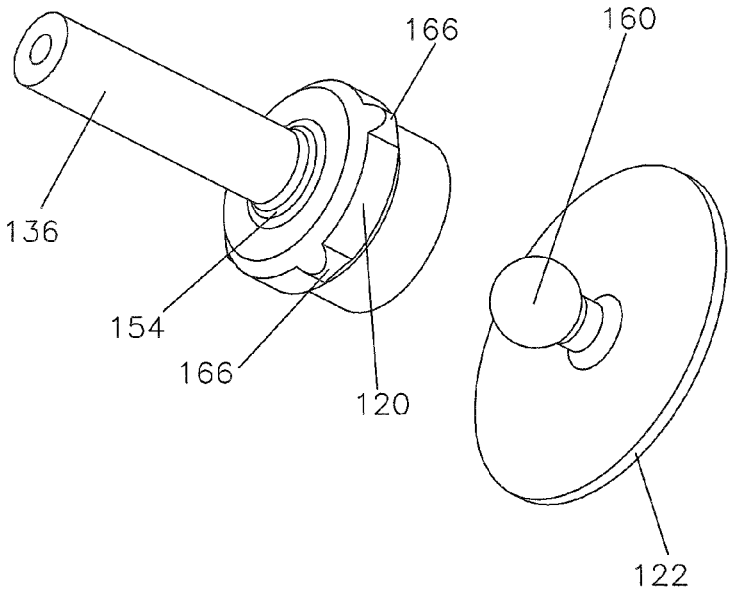
FIGS. 14*a* to 14*d* are different forms of snap fit design between propeller holder and end cap.
Figure 14B:
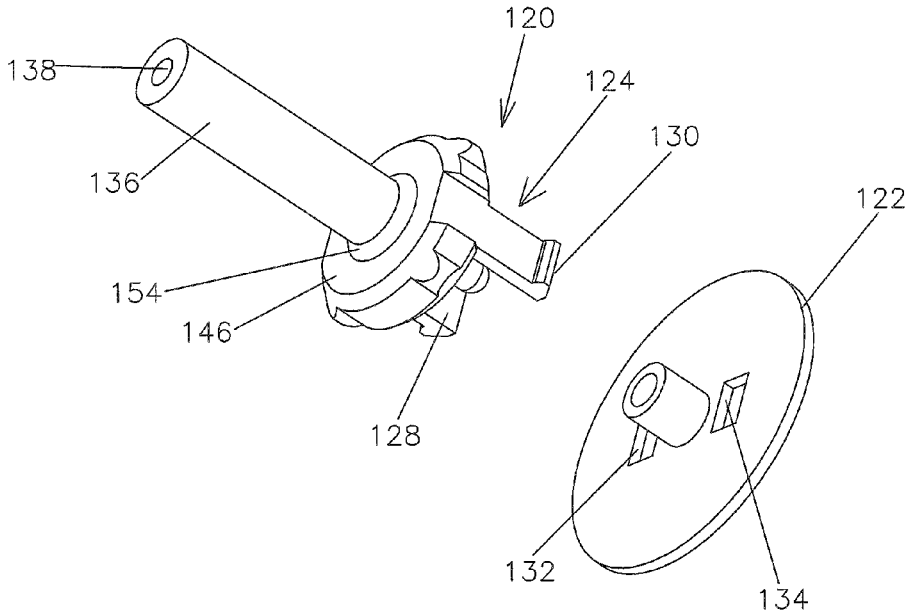
Figure 14C:
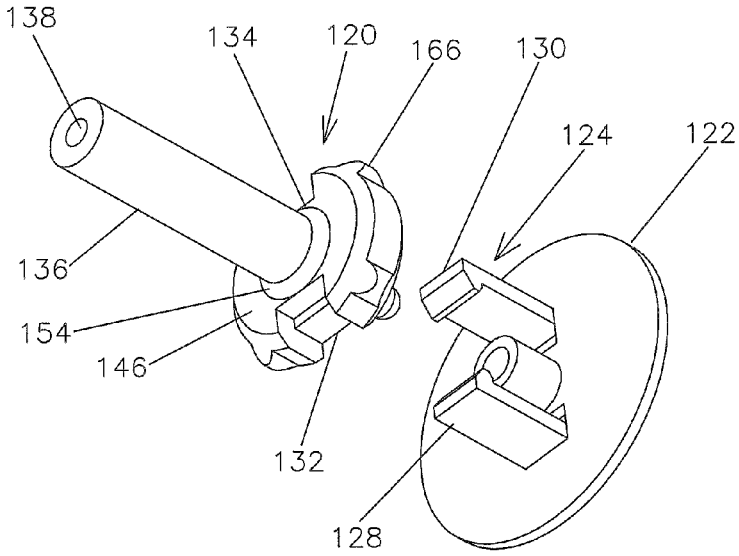
Figure 14D:
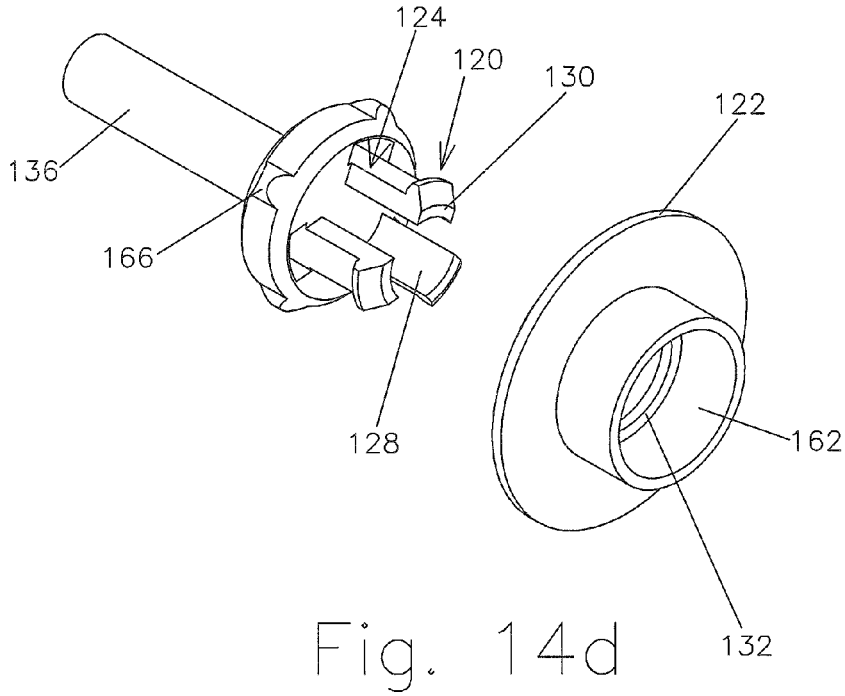
Figure 15A:
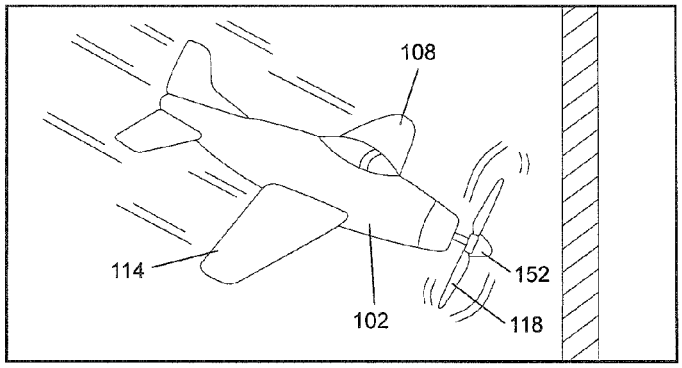
FIGS. 15*a* to 15*d* illustrate the method of how to re-connect the propeller after a hit.
Figure 15B:
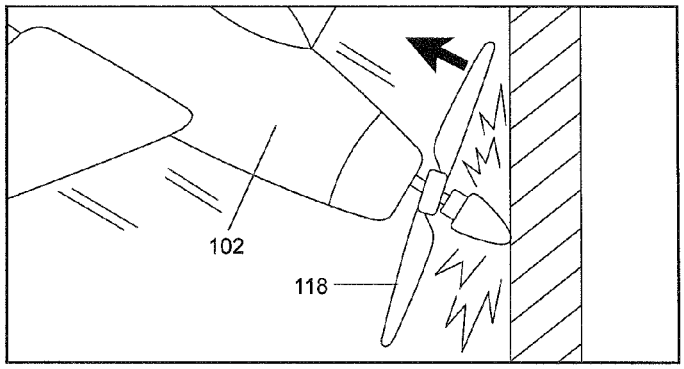
Figure 15C:
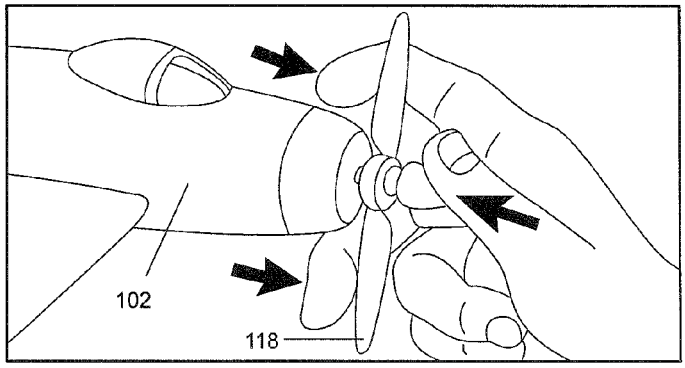
Figure 15D:
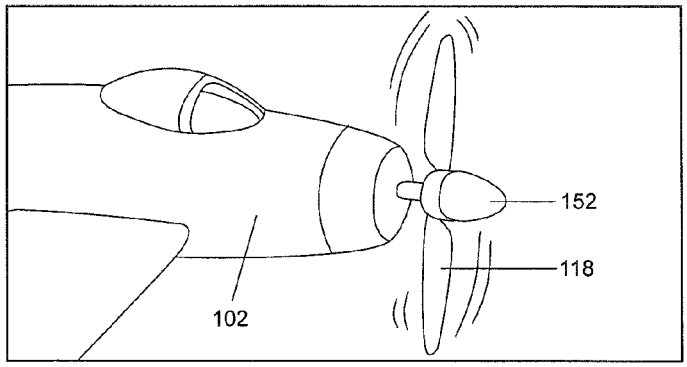
Figure 16A:
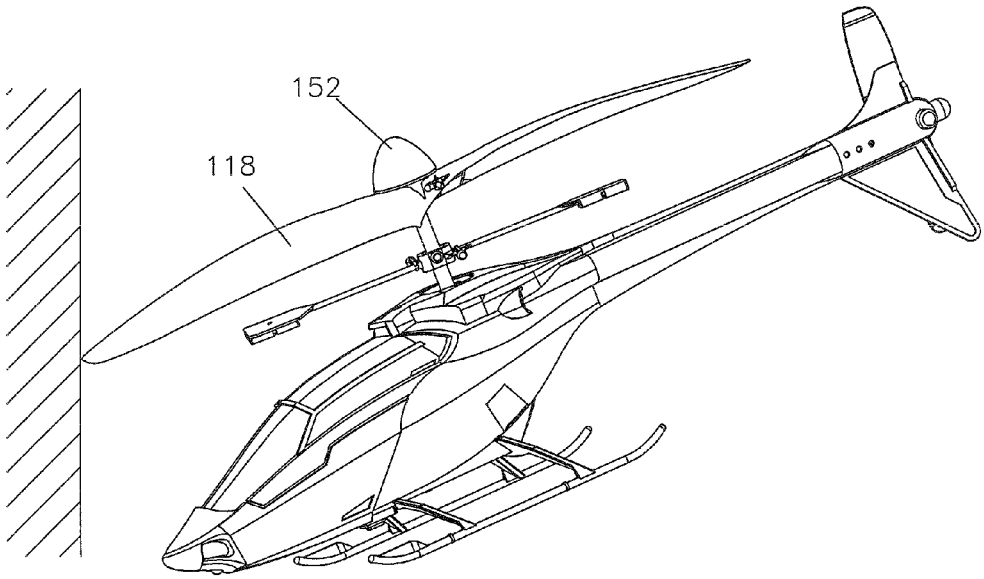
FIG. 16*a* is a perspective view of the helicopter as it initially impacts a hard surface.
Figure 16B:
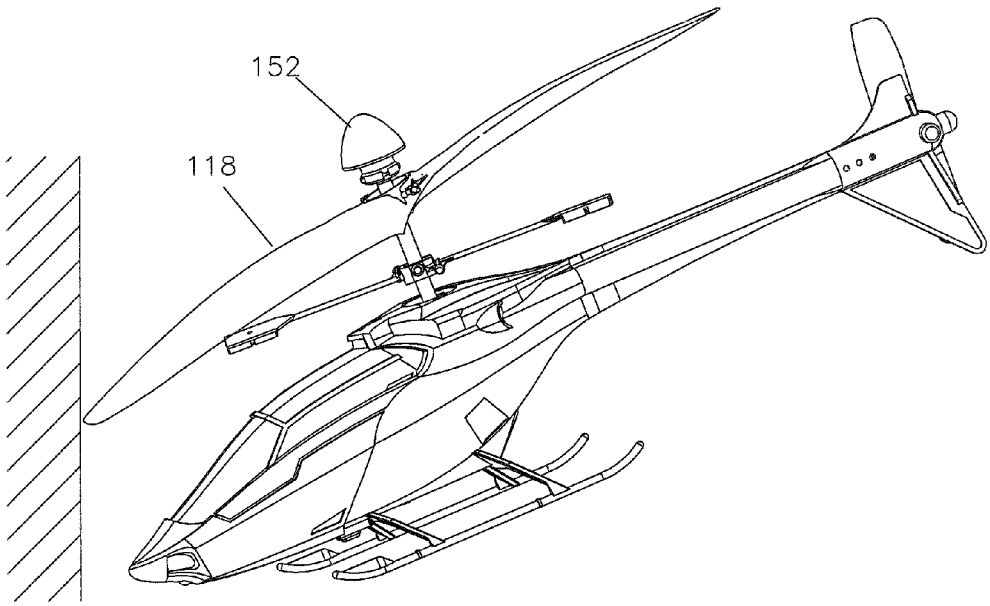
FIG. 16*b* is a perspective view of the helicopter as it further impacts on the hard surface and the propeller is moved out from the propeller holder.

Certain terminology is used in the following description for convenience only and is not limiting. The word "a" is defined to mean "at least one." The terminology includes the words above specifically mentioned, derivatives thereof and words of similar import. In the drawings, like numerals are used to indicate like elements throughout.

The following description and the drawings illustrate specific embodiments sufficiently to enable those skilled in the art to practice the systems and methods described herein.

Other embodiments may incorporate structural, method, and other changes. Examples merely typify possible variations.

The present disclosure presents an improved structure and method for powering the flight of a toy airplane so that the propellers of the airplane are better protected from damage in the event of a crash.

A flying toy 100 has a propeller 118 rotated by the first motor 116 mounted in or on the body or fuselage 102. A propeller holder 120 mounts the propeller 118. An end cap 122 is located to the front of the propeller holder 120, and there is a snap joint 124 between the holder 120 and the end cap 122. The end cap 122 is removable by disengagement of the holder 120 and the end cap 122 at the snap joint 124. Also the propeller 118 is releasable from the holder 120 by a human hand and without a tool. When the toy plane 100 crashes, the propeller 118 is forced relatively free from the drive force rotating the holder 120 and back towards the body or fuselage 102 and is trapped against separation from the toy 100.

The flying toy 100 comprises the body 120, a first propulsion unit being a first motor 116 and a first propeller 118 rotated by the first motor 116 mounted in the body 102. The propeller holder 120 mounts the propeller 118 and the end cap 122 for location on the front of the propeller holder 120.

The end cap 122 is removable by disengagement of holder 120 at the snap joint 124, and the propeller 118 is releasable from the holder 120 by a human hand and without a tool.

In one form there is a toy airplane with a fuselage, a first wing and a second wing attached to and extending from opposite sides of the fuselage.

In another form there is a toy helicopter comprising a fuselage. The first propulsion unit includes a first motor and a first rotor rotated by the first motor mounted on the fuselage. A rotor holder mounts the rotor and there is an end cap for location to the front of the rotor holder, and a snap joint between the holder and the end cap. The rotor is releasable from the holder by a human hand and without a tool.

The removal of the propeller 118 is by hand action and is an action away from the body 102. The holder 120 includes an interface surface 126, and the propeller 118 includes a mating interface bore 128 for accommodation of the propeller 118.

The snap joint 124 includes at least one extending arm 128 and another extending arm 130 to either side of the longitudinal axis of the holder 120 and the end cap 122. As illustrated the arms extend rearwardly from the end cap 122 to mating receivable slots 132 and 134 in the holder 122. The system could be reversed and the arms could extend from the holder to the end cap.

The arms are engagable in the slots and dis-engagable from the slots by snap action.

The holder 122 includes a drive shaft 136 with hollow bore 138 for engagement with a drive shaft 142 from the motor 116 or the driveshaft 140 from the gear box 144.

The holder 122 includes a stub 146 for mounting the propeller 118. The propeller 118 has a bore 148 for accommodation on the stub 146, and the stub 146 and bore 148 have an interface whereby the propeller 118 is mountable for normal operation to be rotatable in an essentially right angular transverse plane with the drive shaft 136.

The propeller 118 is removable under force to a disengaged position that is non-right angular transverse plane with the drive shaft 136. The removal is towards the body 102, and such removal effectively disengages the propeller 118 from the drive shaft 136. The disengagement traps the propeller 118 at least in part between the body 102 and the stub 146.

The stub 146 interface edge 126 includes a relatively pointed edge 150, the edge 150 being directed substantially transverse to the direction of the shaft, thereby to facilitate separation of the propeller 118 towards the body 102 when the propeller 118 is under a force forcing it rearwardly, such as when hitting hard object.

There is an end tip 152 over the end cap 122, the end tip being a relatively shock absorbing material.

The relatively loose engagement between the front section of propeller holder 120 and the propeller 118 is configured such that a longitudinal force forwardly applied to the propeller 118 permits the propeller 118 to slide along a slot and moved out from front section without the need of a tool. This is when the end cap 122 has been removed.

A drive shaft linkage between the rear section 154 of propeller holder 120 and a shaft 136 with the motor shaft 142 or output shaft 140 of the gear box driven by the motor shaft 142 effects the rotation of the propeller 118.

The interface between the circumferential outer surface of the holder 120 and the bore 148 of the propeller 118 is relatively loose whereby the propeller 118 is relatively free to move rearwardly towards the rear of the holder 120.

The interface between the holder 120 and the propeller 118 is formed whereby a force exerted from the front of the propeller 118 due to a crash permits the propeller to move from the front section of propeller holder and move towards the rear section of the holder. In the rear section of the holder 120 the propeller 118 is disengaged from the drive force rotating the holder 120.

The structure between the front of the body 102 and the end cap 122 is such that with the end cap 122 in place, the propeller 118 is either on the holder 120 in the drive mode with the motor or removed from the drive mode of the holder 120 and relatively free from the drive mode in relation to the holder and is within the rear section of propeller holder 120.

There is a radio receiver 620 in the toy and the toy being operatively through a transmitter 600.

The front of the holder 120 includes a ball joint 160 for fitting inside the bore 162 of the end cap 122. The inside of the bore 148 of the propeller 118 can have a series of longitudinal slots 164 for engagement with mating slots on the outside circumference of the holder 120 and when in engagement and operation in the drive mode this positive interaction and engagement transfer the drive power to the propeller 118. The longitudinal slots 164 are in the rear portion of the propeller bore 148. The mating formations 166 are provided at the forward end of the holder 120.

The propeller holder has three basic functions.

Firstly, with the snap joint design, the end cap can be held firmly to the front section of propeller holder. This joint is expected to be released by human hand without tools.

Secondly, tight fit slot design between the front section of propeller holder and propeller is not necessary. Once a longitudinal force is applied to the propeller, it can be slid along the slot and moved out from front section easily. When the motor is on, the propeller rotates. It produces a lot of thrust to the rear side. According to the Newton's 3rd law, the reaction force will push the propeller towards the end cap. The end cap acts as a stopper to avoid the propeller moving away from the propeller holder.

Thirdly, the rear section of propeller holder links firmly with the motor shaft or output shaft of gear box. As there is no slot in this section, the propeller can be free to move.

While hitting, force is exerted to the propeller from its front, the protection tip absorbs portion of the energy. The remaining force pushes the propeller to move out from the front section of propeller holder and it goes towards the rear section in which the propeller is free to move. Because of this transition, the propeller is disengaged from motor. Therefore, there is no additional force from motor against the external impact force. This will minimize the chance of broken propeller significantly.

Another advantage of present disclosure is that the propeller can free but keep staying within the rear section of propeller holder after crash, so the player is not required to seek or pick up the propeller from the floor. After motor stop, the propeller can be simply re-connected to its holder by hand.

For propeller replacement, the end cap design permits the cap to be easily removed by player for replacing a new propeller or installing different pitches or sizes of propeller to its holder. To complete the process, just simply snapping the end cap back to the holder again permits the toy to be reset into operation mode.

The detachable mechanism of a flying toy comprises:

Driving motor and/or output gearbox

Main shaft

Propeller holder

Propeller

End cap

Protection tip

There are a plurality of slots on front section of propeller holder for power transmission from motor to propeller.

The protection tip is made of soft material such as PP, EPP or EVA foam for absorbing portion of impact energy. Alternatively, end cap and protection tip can be integrated to form a single part.

The slot design between propeller holder and propeller can be in different forms. The snap fit design between propeller holder and end cap can be in different forms.

This detachable propeller design can be applied in flying toys such as helicopters, planes or multi-rotor flying objects.

The flying toy airplane 100 has a fuselage 102, and a first wing 108 and a second wing 114 attached to and extending from opposite sides of the fuselage 102. A first propulsion unit, having a motor 116 and a propeller 118 rotated by the motor 116, is mounted on the front of the fuselage 102. In other cases there can be multiple propulsion units and they can be mounted on each of the wings 108 and 114.

The airplane 100 includes a receiver unit 620 to receive control signals from a ground-based transmitter unit for use in controlling the flight of airplane 100. There can be a charging socket of receiver unit 620 for used to couple a rechargeable battery mounted in airplane 100 to an external charger, for instance in the transmitter unit.

The transmitter unit 600 has an antenna that may be used to communicate with receiver unit 620. Transmitter unit 600 has a throttle control stick to control power to motor 116, and has a left/right control stick for directing airplane 100 to turn left or right.

The airplane 100 can be a typically light-weight airplane designed for immediate re-use and flight after one or more minor crashes into the ground or other obstacles. It is expected that such minor crashes will not prevent the continued flying enjoyment of a user of airplane 100. The propulsion system and placement as described above aids in enabling this re-use by helping to avoid catastrophic failures of the propeller or other features of the airplane that might be damaged by other mounted placement as in prior toy planes. The size of airplane 100 may be, for example, less than 12 inches long and 10 inches wide, and the weight of airplane 100 including a rechargeable battery may be, for example, less than about 20 g.

The mounting of the propeller should be for minimizing damage to the motors, drive shaft, and/or propellers during a crash or hard landing or other hard usage. Also, the hazard to children from the propeller is reduced. The airplane 100 has a fuselage 102 can be formed of a break-resistant material such as, for example, a polyfoam or other soft and/or deformable materials so that a crash or hard landing by airplane 100 does not cause significant structural damage. The wings and tail of airplane 100 are also preferably formed of such a break-resistant material.

It will be understood that the remote controller can be formed of a variety materials and may be modified to include additional switches and/or buttons. It will be further understood that a variety of other types of controllers may be used to control the operation of the toy vehicle of the present disclosure.

This disclosure is not limited to the particular embodiments disclosed, but it is intended to cover modifications within the spirit and scope of the present disclosure.

It should be noted that the present propulsion structure and method may also be used on airplanes having multiple wings on each side. Also the system can be used on any flying toy that has a rotatable propeller or rotor and helicopters with one rotor or tandem rotors.

Also, infrared or programmable control may be used as alternatives to radio control. In addition, lithium ion batteries, high-density capacitors, and other power sources may be used on airplane 100.

By the foregoing disclosure, an improved structure and method for propelling a flying toy airplane have been described. The foregoing description of specific embodiments reveals the general nature of the disclosure sufficiently that others can modify and/or adapt it for various applications without departing from the generic concept.

The present disclosure may be embodied in specific forms without departing from the essential spirit or attributes thereof. In particular, although the disclosure is illustrated using a particularly format, one skilled in the art will recognize that various values and schematics will fall within the scope of the disclosure. It is desired that the embodiments described herein be considered in all respects illustrative and not restrictive and that reference be made to the appended claims and their equivalents for determining the scope of the disclosure.

The invention claimed is:

1. A flying toy comprising: a body, a first propulsion unit, having a first motor and a first propeller rotated by the first motor mounted on the body, a propeller holder for mounting the propeller including an end cap for location in front of the propeller holder, a snap joint between the holder and the end cap, the end cap being removable by disengagement of the holder and the end cap at the snap joint, and the propeller being releasable from the holder by a human hand and without a tool, and the holder including a drive shaft for engagement with the motor, a stub for mounting the propeller, the propeller having a bore for accommodation on the stub, the stub and bore having an interface whereby the propeller is mountable for normal operation to be rotatable by the drive shaft in an essentially right angular transverse plane with respect to the drive shaft, and wherein with the drive shaft rotating in a normal drive mode, and with a removal of the propeller towards the body, such removal effectively disengages the propeller from the drive shaft whereby the drive shaft rotates in the normal drive mode and the propeller is removed from the rotating drive action and is trapped at least in part between the body and the stub.

2. A toy airplane comprising: a fuselage having a first wing and a second wing attached to and extending from opposite sides of the fuselage; a first propulsion unit, having a first motor and a first propeller rotated by the first motor mounted on the airplane, a propeller holder for mounting the propeller including an end cap for location in front of the propeller holder, a snap joint between the holder and the end cap, wherein the propeller is releasable from the holder by a human hand and without a tool, and the holder including a drive shaft for engagement with the motor, a stub for mounting the propeller, the propeller having a bore for accommodation on the stub, the stub and bore having an interface whereby the propeller is mountable for normal operation to be rotatable by the drive shaft in an essentially right angular transverse plane with respect to the drive shaft, and wherein with the drive shaft rotating in a normal drive mode, and with a removal of the propeller towards the body, such removal effectively disengages the propeller from the drive shaft whereby the drive shaft rotates in the normal drive mode and the propeller is removed from the rotating drive action and is trapped at least in part between the body and the stub.

3. A toy helicopter comprising: a fuselage; a first propulsion unit, having a first motor and a first rotor rotated by the first motor mounted on the fuselage, a rotor holder for mounting the rotor including an end cap for location in front of the rotor holder, a snap joint between the holder and the end cap, wherein the rotor is releasable from the holder by a human hand and without a tool, and the holder including a drive shaft for engagement with the motor, a stub for mounting the propeller, the propeller having a bore for accommodation on the stub, the stub and bore having an interface whereby the propeller is mountable for normal operation to be rotatable by the drive shaft in an essentially right angular transverse plane with respect to the drive shaft, and wherein with the drive shaft rotating in a normal drive mode, and with a removal of the propeller towards the body, such removal effectively disengages the propeller from the drive shaft whereby the drive shaft rotates in the normal drive mode and the propeller is removed from the rotating drive action and is trapped at least in part between the body and the stub.

4. The toy as claimed in claim 1 wherein the release of the propeller by hand is an action away from the body.

5. The toy as claimed in claim 1 wherein the snap joint includes at least one extending arm on one of the holder or the end cap, and a receivable slot on the other of the holder or the end cap, the arm being engagable in the slot and dis-engagable from the slot by snap action.

6. The toy as claimed in claim 1 wherein the propeller is removable under force to a disengaged position that is in a non-right angular transverse plane with the drive shaft.

7. The toy as claimed in claim 6 wherein the stub interface includes a relatively pointed edge, the edge being directed substantially transverse to the direction of the drive shaft, thereby to facilitate separation of the propeller towards the body under force.

8. The toy as claimed in claim 6 including an end tip over the end cap, the end tip being a relatively shock absorbing material.

9. The toy as claimed in claim 1 including a relatively loose engagement between a front section of the propeller holder and the propeller wherein a longitudinal force applied to the propeller permits the propeller to slide along a slot and move out from the front section without the need of a tool.

10. The toy as claimed in claim 1 including a linkage between a rear section of propeller holder and the drive shaft or an output shaft of a gear box driven by the drive shaft, and wherein the interface between the holder and the propeller is relatively loose whereby the propeller is relatively free to move rearwardly towards the rear section of the holder.

11. The toy as claimed in claim 1 wherein a force exerted from a front of the propeller permits the propeller to move from a front section of the propeller holder towards a rear section of the propeller holder, and the propeller is disengaged from a drive force rotating the propeller holder when positioned in the rear section.

12. The toy of claim 1 further comprising a radio receiver in the toy and the toy being operative through a transmitter.

13. The toy airplane as claimed in claim 2 wherein the release of the propeller by hand is an action away from the body, and wherein the snap joint includes at least one extending arm on one of the holder or the end cap, and a receivable slot on the other of the holder or the end cap, the arm being engagable in the slot and dis-engagable from the slot by snap action.

14. The toy airplane as claimed in claim 2 wherein the propeller is removable under force to a disengaged position that is in a non-right angular transverse plane with the drive shaft.

15. The toy helicopter as claimed in claim 3 wherein the release of the rotor by hand is an action away from the body, and wherein the snap joint includes at least one extending arm on one of the holder or the end cap, and a receivable slot on the other of the holder or the end cap, the arm being engagable in the slot and dis-engagable from the slot by snap action.

16. The toy helicopter as claimed in claim 3 wherein the propeller is removable under force to a disengaged position that is in a non-right angular transverse plane with the drive shaft.

17. A method of operating a flying toy having: a body, a first propulsion unit, having a first motor and a first propeller rotated by the first motor mounted on the body, a propeller holder for mounting the propeller including an end cap for location in front of the propeller holder, a snap joint between the holder and the end cap, the holder including a drive shaft for engagement with the motor, a stub with the holder for mounting the propeller, the propeller having a bore for accommodation on the stub, the stub and bore having an interface and comprising the steps of:

mounting the propeller with the stub for normal rotatable operation by the drive shaft in an essentially right angular transverse plane with respect to the drive shaft;

rotating the drive shaft in a normal drive mode thereby causing rotation of the propeller, removing the propeller towards the body under a force from a forward end of the body towards the body, effectively disengaging the propeller from the drive shaft by urging the propeller towards the body;

trapping the propeller at least in part between the body and the stub; and continuing rotation of the drive shaft in the normal drive mode with the propeller removed from the rotating drive action and in the trapped location.

18. The method of operating a flying toy as claimed in claim 17 including removing the end cap from the holder by disengagement of the snap joint, and releasing the propeller from the holder by a human hand and without a tool.

* * * * *